United States Patent [19]

Fredrickson et al.

[11] Patent Number: 4,770,414

[45] Date of Patent: Sep. 13, 1988

[54] BODY EXERCISING DEVICE

[76] Inventors: Eric Fredrickson, 1469 E. 24th St., Brooklyn, N.Y. 11210; Joseph Vernola, 33 N. Indiana Ave., Lindenhurst, N.Y. 11757

[21] Appl. No.: 60,970

[22] Filed: Jun. 17, 1987

Related U.S. Application Data

[63] Continuation of Ser. No. 811,516, Dec. 20, 1985, abandoned.

[51] Int. Cl.[4] ..... A63B 21/00

[52] U.S. Cl. ..... 272/126; 272/93

[58] Field of Search ..... 272/125, 126, 93, 94, 272/118, 106, 116, 117, 122, 123, 127, 128, 111; 224/265, 266; 273/35 R, 189 R; D24/64

[56] References Cited

U.S. PATENT DOCUMENTS

| | | | |
|---|---|---|---|
| 405,028 | 6/1889 | Stockburger . | |
| 802,026 | 10/1905 | Beall . | |
| 966,562 | 8/1910 | Knoerzer . | |
| 1,145,127 | 7/1915 | Dunnebacke et al. . | |
| 1,714,391 | 3/1927 | McWhirter . | |
| 2,601,088 | 1/1948 | Burgess . | |
| 2,986,314 | 10/1959 | Miller . | |
| 3,109,244 | 11/1963 | Trifaro et al. . | |
| 3,588,102 | 6/1971 | Gifford | 272/126 |
| 3,820,781 | 6/1974 | Kane | 272/93 |
| 3,874,660 | 4/1975 | Brethen . | |
| 3,926,430 | 12/1975 | Good, Jr. . | |
| 3,957,266 | 5/1976 | Rice . | |
| 4,226,414 | 10/1980 | Coffaro et al. . | |
| 4,257,591 | 3/1981 | Evans | 272/93 |
| 4,275,882 | 6/1981 | Grosser et al. . | |
| 4,344,619 | 8/1982 | Szabo . | |
| 4,440,391 | 4/1984 | Saenz et al. | 272/93 |
| 4,565,367 | 1/1986 | Kaiser | 272/126 |

OTHER PUBLICATIONS

"Atlantic Fitness Products" Catalog, 170 Penrod Court, Glen Burnie, Md., 21061. Nov. 1, 1985, pp. 30, 43.

*Primary Examiner*—Richard J. Apley
*Assistant Examiner*—S. R. Crow
*Attorney, Agent, or Firm*—Hedman, Gibson, Costigan & Hoare

[57] ABSTRACT

A rigid exercising bar device for performing twisting and bending exercises about the waist is provided, comprising an elongated curved middle portion and two curved end portions, the middle portion being bowed or contoured for a comfortable and effective fit around the neck and on the shoulders, the end portions being curved along a different plane and outwardly and downwardly relative to the middle portion, and serving as hand grips for the user such that the arms are comfortably extended during use.

9 Claims, 2 Drawing Sheets

BODY EXERCISING DEVICE

RELATED APPLICATION

This application is a continuation of application Ser. No. 811,516 filed Dec. 20, 1985, now abandoned.

BACKGROUND OF THE INVENTION

1. Field of the Invention

This invention relates to exercising devices for mounting on the shoulders and behind the neck to perform twisting and bending motions about the waist for firming and toning the muscles and tissues.

2. Description of the Prior Art

The human body exercise sometimes referred to as "twists" generally involves placing a shaft-like device, or exercising bar, along the back of the neck and resting on the shoulders, with the arms draped over the top of the bar or the hands grasping the ends. The user then goes through a series of exercising movements, the natural result of which is to exert tension on muscles and tissues of the chest, stomach, sides and lower back. In one of those movements, the body is twisted, or rotated, from side to side. In another, the body is bent at the waist while the user attempts to touch one end of the shaft or bar to the opposite foot. A number of devices have been designed to perform these exercises, including some described in the patent literature. None of them are entirely satisfactory, however.

For instance, a very common device for this exercise is an ordinary broom handle. It has the attributes of being light in weight and easy to use, and also the obvious benefits of being relatively inexpensive and readily available. Unfortunately, it is also very uncomfortable, causing unnecessary strain because the shoulders must necessarily be retracted far backward to accommodate the straight line of the shaft.

Variations on this straight shaft theme occur in the patent literature. U.S. Pat. No. 4,518,162 (William J. Oates, dated May 21, 1985) describes a weighted exercise bar which comprises joined sections and weighted end portions. U.S. Pat. No. 4,257,591 (Kenzell Evans, dated May 24, 1981) describes another exercise device, comprised of a plurality of sections, with vertically disposed hand grips on the ends. The devices of these patents are essentially constructed of straight shafts, and they would be expected to suffer from the same shortcomings of an ordinary broom handle.

A somewhat better design is shown in U.S. Pat. No. 3,820,781 (John F. Kane, dated June 28, 1974). The bar device described there has a yoke-like midsection, roughly in the shape of a semi-circle, which fits around the user's neck. This enables the shoulders to be held more forward and the neck in a more comfortable upright position while the bar is being used.

SUMMARY OF THE INVENTION

It is an object of this invention to provide an improved exercising device for exercising the human body torso and waist.

It is a further object of this invention to provide an improved exercising device which offers greater muscular comfort in combination with muscular extension during the performance of bending and twisting motions, while maintaining the shoulders in a fixed position relative to one another, with the arms comfortably extended.

It is another object of this invention to provide an exercising device the length of which can be adjusted to suit the particular user's arm span.

It is still another object of the present invention to provide positive hand holds for grasping the device in a comfortable manner and which enhances the effectiveness of the exercise.

These objects are achieved with the present invention described here.

Briefly, the present invention comprises an exercising device which is to be placed behind the user's neck and supported on the shoulders, for performing twisting and bending exercises about the user's waist (the exercise sometimes known as "twists"). The device comprises an elongated rigid bar of a predetermined length, preferably though not necessarily variable, having an elongated middle portion and two shorter opposite end portions which are continuous with the middle portion.

The middle portion of the exercising bar is curved along a first plane which is substantially horizontal relative to the user when in the upright (starting) position. This curvature is relatively gentle, and it differs from prior art devices designed with a yoke-like middle portion in the shape of a semi-circle. The present device employs a less severe curvature at in center portion (that is, less than semi-circular), such that the middle portion of the bar extending from one end portion to the other end portion somewhat resembles an archer's traditional long bow. The center of this curvature, moreover, is fixed at or about mid-way so that it will be located directly behind the user's neck when the bar is properly shouldered for exercising.

The two opposite end portions, on the other hand, are curved along a second plane, which is substantially vertical to the user in the upright position and, more specifically, perpendicular or nearly perpendicular to the first plane. Each of these end portions is shorter in length than the middle portion of the bar and is designed essentially to be gripped with the user's hand. Moreover, they are distanced sufficiently from the center point of the middle portion of the bar such that the user's arms will be fully or comfortably extended when gripping them.

DESCRIPTION OF THE DRAWINGS

The design and construction of the exercising device of this invention will be better understood by referring to the accompanying drawings, which show a preferred embodiment.

DESCRIPTION OF THE PREFERRED EMBODIMENT

Figure 1:
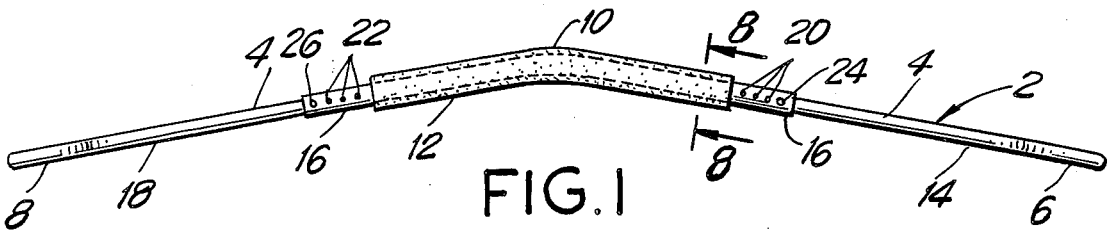
FIG. 1 is a top plan view of an exercising device constructed according to the present invention.

Referring to the drawings, in FIG. 1 an elongated exercising bar device 2 according to the present invention is illustrated which comprises an elongated middle portion 4 and, continuous therewith, two end portions, 6 and 8, respectively. Middle portion 4 is curved or bowed gently at its center, as shown. End portions 6 and 8 are also curved, but outwards and downwards relative to middle portion 4. Mid point 10 of middle portion 4 is located approximately equidistantly between end portions 6 and 8, thus maintaining symmetry between the left and right halves of bar 2.

Exercising bar device 2 optionally includes resilient padding 12, which is wrapped around middle portion 4 of the bar for part, not all, of its length. This may be made, for instance, of cloth rubber or foamed rubber, which is wrapped around the bar in one or more layers. Its purpose is to cushion the bar against the user's neck and shoulders, thus enhancing the physical comfort and preventing skin abrasion when the bar is in use.

So that the length can be adjusted, the bar is preferably constructed in three tubular segments or members, 14, 16 and 18, respectively. The diameters of first member 14 and third member 18 are smaller than the 18 can slide into and out of member 16 in telescope manner. It is also possible to construct the telescoping members such that the diameters of 14 and 18 are larger than that of 16, but still permitting essentially the same telescopic sliding movements relative to one another. Member 16 contains two series of aligned spaced-apart holes, or perforations, 20 and 22, respectively, which extend completely through the tubular wall of member 16 on one side. Telescoping members 14 and 18 each contains a retractable pin, or button, (not shown in FIG. 1, but see FIGS. 2 and 9), aligned on the same path as 20 and 22, which can extend into any of the holes and thus lock members 14 and 18 firmly into place relative to member 16.

Figure 2:
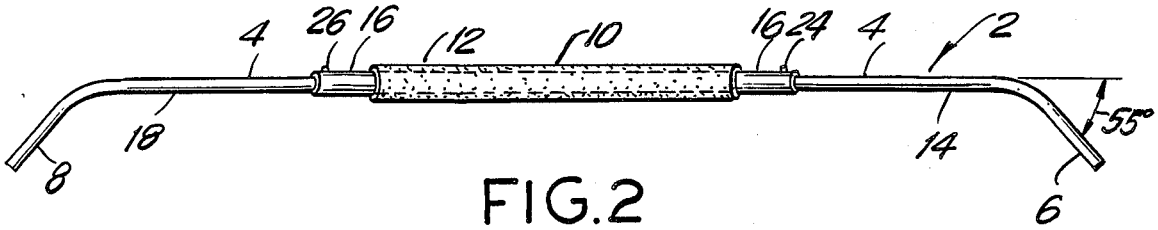
FIG. 2 is a full front view of the device of FIG. 1.

Looking at FIG. 2, as viewed from the front (or back), when bar 2 is parallel to the floor, end portions 6 and 8 are seen to curve outwardly and downwards from middle portion 4. Experience has shown that hand grasping end portions 6 and 8 should be depressed preferably at an angle of about 50° to 60° relative to the horizontal plane of middle portion 4 of the device, and especially about 55°, as shown in FIG. 2. Variations in these angles are permissible, although they appear to be the optimum ones for greatest comfort and ease of use, as well as for best results in obtaining the desired muscle tension in the extended arms. Retractable buttons 24 and 26, of telescoping segments 14 and 18, respectively, are shown fully extended through the aligned holes in middle segment 16.

Figure 3:
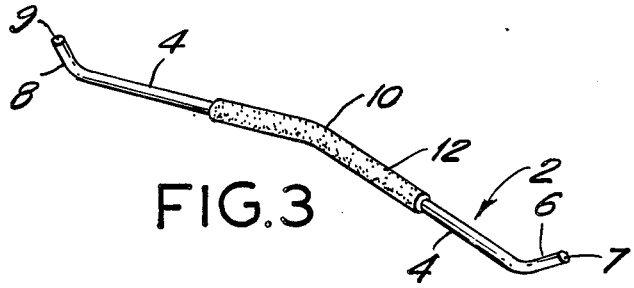
FIG. 3 is a perspective view of the same device, showing curvature along two planes.
Figure 6:
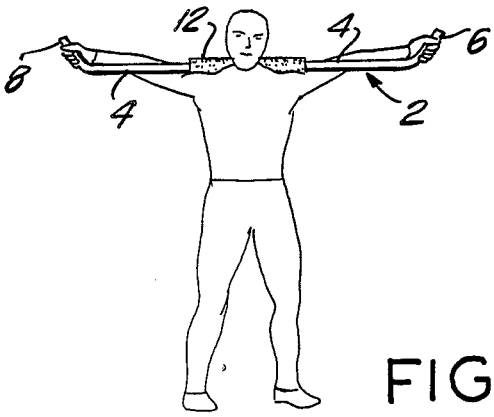
FIG. 6 is a frontal view of a user utilizing the same device as in FIGS. 4 and 5, but now with the handles of the bar turned up to provide alternative gripping and arm resting positions.
Figure 7:
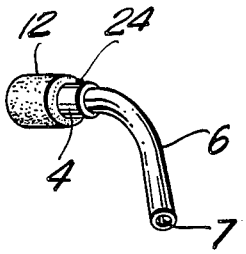
FIG. 7 is a side perspective view from one end of a part of the exercising device.

The curvature of the bar in two planes can best be seen in FIG. 3, showing end portions 6 and 8 in an upright position, which is another way in which the bar can be held during use to achieve essentially the same results, as illustrated in FIG. 6. It is preferred that ends 7 and 9 of end portions 6 and 8, respectively, be blunt or flat, with corners rounded or beveled for greater safety. If desired, padded or softened end caps can be used.

Figure 4:
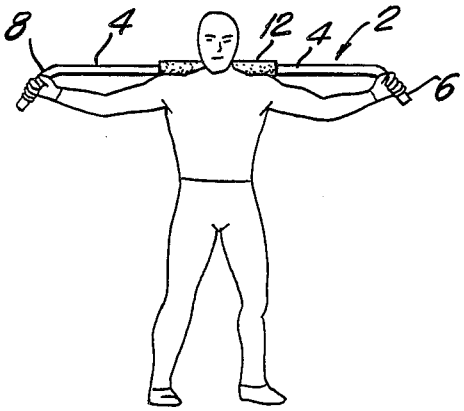
FIG. 4 is a front view showing the starting position of a user utilizing the same device.

As best seen in FIG. 4, in use the bar (which is shown in the same frontal view as in FIG. 2) is held by the user across the back of the neck and on the shoulders, parallel to the floor, with the arms extended to either side, while firmly gripping end portions 6 and 8, here in the downward position. Resilient padding 12 cushions the bar against the user's neck and shoulders, to prevent skin abrasion and to serve as a soft medium between the skin and the harder surface of the rigid bar. The extension of the arms in this way, which is possible because of the user firmly gripping the end portions, exerts increased tension in the muscles and tissues of the user's chest, arms and shoulders, thus benefitting them also by the exercising activity.

Figure 5:
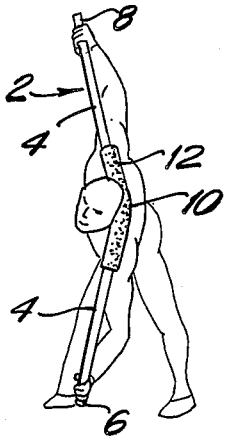
FIG. 5 is an elevational plan view illustrating an active position of a user utilizing the device.

As seen in FIG. 5, which shows the bar in use during the twisting exercise, with the bar held firmly in place the user bends from side-to-side, moving toward the toe or foot on the opposite side of the body and finishing in its vicinity (but not touching with the bar itself). The movement is then alternated to the other side. The benefits of this exercise are apparent. The muscles and tissues around the waist are firmed and toned. In addition, because of the improved design, similar results are achieved for the upper torso and arms for the reasons explained above. Side-to-side rotating movements without bending are also possible during the performance of the exercise.

Figure 8:
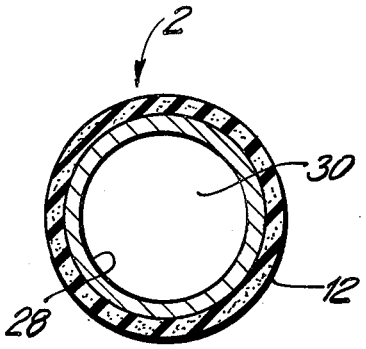
FIG. 8 is a cross-sectional view of the device, taken along lines 8, 8 in FIG. 1, showing its tubular construction.

For a variety of reasons, the bar device is preferably constructed of tubular material, such as metal (for example, aluminum) or plastic. This results in a lighter weight, easier-to-use device, which is also easier to manufacture. It is noteworthy that the simplicity of the present design permits relatively inexpensive manufacture of the device from easily obtained, off-the-shelf materials. Unlike certain prior art devices that must be carefully shaped to achieve a yoke-like, semicircular mid portion, which usually entails expensive molding or shaping operations, the present device can be constructed from a unitary piece of tubular metal which is easily bent to shape using commonly available metal-working tools. The tubular construction obviously is also necessary if a telescoping arrangement is desired to adjust the length of the bar to accommodate the individual user. The tubular construction can be seen in FIG. 8, which is a cross-sectional view of member 16 of bar 2. As illustrated, the outer surface of tubular wall 28 of bar 2 is sheated with resilient padding 12, which extends completely around the circumference. Cavity 30 permits slidable entry of telescoping tubular members 14 and 18 (not shown).

Figure 9:
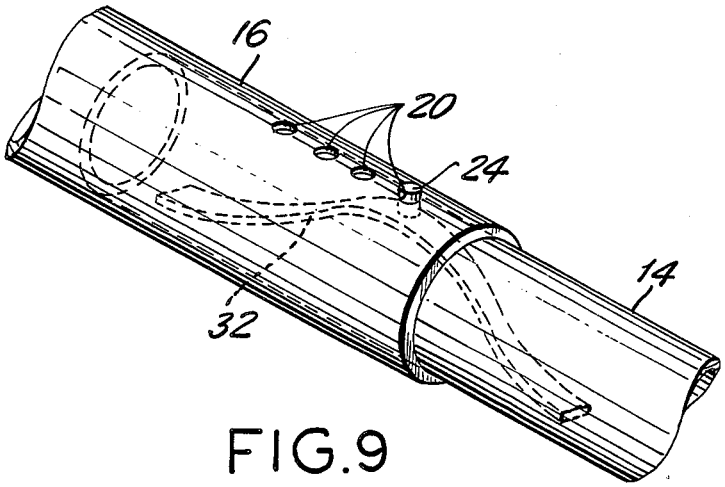
FIG. 9 is a perspective view of a portion of the device in close up, showing a telescoping arrangement whereby the length may be adjusted.

As seen in FIG. 9, tubular member 14 of bar 2 is slidably mounted in cavity 30 of tubular member 16. The wall of member 16 contains a series of holes or perforations, 20, which are in straight alignment, and each of which is at an equal distance from the adjacent holes. Tubular member 14 is outfitted with retractable button 24, which is capable of fitting into holes 20. Button 24 extends through the wall of tubular member 14 and is retractable by virtue of being mounted on flexible metal clip 32. When button 24 is depressed, such as by ordinary finger pressure, metal clip 32 extends and button 24 is pushed down below the hole. At the same time, tubular member 14 is slidably moved relative to tubular member 16, so that no hole is aligned with button 24. This will keep button 24 in the retracted position, but under tension. As the sliding movement of member 14 is continued relative to member 16, the next hole position will become aligned eventually with button 24, whereupon it pops up into the hole and locks the tubular members 14 and 16 in that position.

The present invention provides clear advantages over prior art devices such as those of the above mentioned Kane and Evans patents. Exercising bars with yoke-like designs such as Kane's are necessarily more difficult and expensive to manufacture. If such a device is to be constructed of metal, plastic or fiberglass, for instance, about the only way is to mold it or extrude it through a die, and these procedures are costly. Moreover, the use of tubular materials would seem to be prohibited by the very nature of the manufacturing processes. In addition, the severe curvature of the yoke makes it difficult to cushion with a soft material (in contrast, the device of the present invention, because of its more gradual curvature, is easily wrapped or sheathed, as practice has shown).

Evans, on the other hand, employs hand grips which are rather awkward to use and which will produce arm or wrist fatigue after a time. That device is also complicated to manufacture, because of the number of parts that make it up. The means for extending the bar length appear to be potentially dangerous, involving apparently exposed ends of sharp steel wire.

The present device, in contrast, fills the need for an inexpensive, easy-to-manufacture exercising device which is also more comfortable and more effective during use.

Of course, modifications in this design are possible without departing from this invention. The exercising bar can be made in the form of a unitary molded or machined piece in an assortment of lengths to allow for the different arm spans of various users. Examples of materials that can be used include plastic, fiberglass and tubular steel or aluminum. If it is desired to construct the bar so that its length can be varied by the user, as shown in the preferred mode here, it is possible to use another way of adjusting the length instead of the telescoping arrangement shown. For instance, the bar can be made in segments which can be screwed onto the ends of one another, and thus variably interchanged as needed. The particular means for adjusting the length, therefore, is not an essential aspect of this invention and any suitable means can be employed. Also, the end portions of the bar which serve as hand holds can be weighted, as by filling the tubular ends with lead or other heavy material, which can further enhance the exercise by providing for additional muscle tension. Still other modifications may occur to those skilled in the art in view of the foregoing description, again without departing from the scope of the present invention and without sacrificing its chief benefits.

We claim:

1. An exercising device for placement behind the neck and on the shoulders for use in twisting and bending exercises about the user's waist, comprising:

an elongated bar of a predetermined length, having an elongated middle portion and two shorter opposite end portions which are continuous with the middle portion, the middle portion comprising of two non-parallel substantially linear segments of substantially equal length which are angled about a center point, said middle portion forming a first plane which is substantially horizontal relative to the user in an upright position, the angle describing an obtuse angle, the two end portions being curved along a second plane which is substantially vertical relative to the first plane, the curved end portions being at a distance from the center point of the middle portion of the bar which permits the user to grip them with the hands while the arms are extended.

2. The exercising device of claim 1, in which the hand-gripping end portions are curved downward at an angle of 50 to 60 degrees relative to the middle portion of the device in the first (horizontal) plane.

3. The exercising device of claim 1, which includes a resilient material wrapped around the midsection of the middle portion of the bar for the prevention of skin abrasion when the exercising device is in use.

4. The exercising device of claim 3, in which the resilient wrapping is a rubbery material.

5. The exercising device of claim 1, which is of variable length.

6. The exercising device of claim 5, which comprises a telescoping arrangement in which the bar is comprised of three sequential tubular segments, the diameter of the second (middle) segment being sufficient to permit telescopically sliding movement of the first and third segments relative to the second (middle) segment.

7. The exercising device of claim 6, in which the bar includes locking means for locking the slidable tubular segments in place relative to one another.

8. The exercising device of claim 7, in which the second (middle) tubular segment includes a series of aligned and spaced-apart holes extending through the tubular wall, and the first and second tubular segments include retractable locking pins for engagement with the holes such that when the pins are inserted into the holes, the tubular segments are locked in place relative to one another.

9. The exercising device of claim 1, in which the end portions are weighted.

* * * * *